US005318711A

United States Patent [19]

Evans et al.

[11] Patent Number: 5,318,711

[45] Date of Patent: Jun. 7, 1994

[54] METHOD FOR LUBRICATING METAL-METAL CONTACT SYSTEMS IN METALWORKING OPERATIONS WITH CYCLOHEXYL ESTERS

[75] Inventors: Robert D. Evans, Warminster; Quentin D. Craft, Exton, both of Pa.

[73] Assignee: Quaker Chemical Corporation, Wilmington, Del.

[21] Appl. No.: 7,303

[22] Filed: Jan. 21, 1993

[51] Int. Cl.[5] ..... C10M 105/08; C10M 129/72

[52] U.S. Cl. ..... 252/34; 22/49.5; 22/56 R; 22/57

[58] Field of Search ..... 252/57, 34, 56 R, 49.5; 72/42

[56] References Cited

U.S. PATENT DOCUMENTS

| | | | |
|---|---|---|---|
| 3,057,815 | 10/1962 | Bartlett et al. | 252/57 |
| 3,318,811 | 5/1967 | Conradi et al. | 252/19.9 |
| 3,409,553 | 11/1968 | Scoggins et al. | 252/57 |
| 3,523,084 | 8/1970 | Homewood et al. | 252/56 |
| 3,526,596 | 9/1970 | Kress et al. | 252/49.5 |
| 3,674,692 | 7/1972 | Gothel et al. | 252/56 S |
| 3,681,440 | 8/1972 | Gash | 260/488 J |
| 3,751,452 | 8/1973 | Inamoto et al. | 260/468 G |
| 3,849,473 | 11/1974 | Inamoto et al. | 260/468 G |
| 3,859,335 | 1/1975 | Schindlbauer et al. | 260/484 R |
| 3,923,671 | 12/1975 | Knepp | 72/42 |
| 4,178,261 | 12/1979 | Dhein et al. | 252/57 |
| 4,212,816 | 7/1980 | Hentschel et al. | 260/410.6 |
| 4,228,304 | 10/1980 | Noda et al. | 562/507 |
| 4,259,206 | 3/1981 | Piotrowski et al. | 252/34.7 |
| 4,402,839 | 9/1983 | Davis et al. | 252/34.7 |
| 4,464,277 | 8/1984 | Cousineau et al. | 252/57 |
| 4,786,427 | 11/1988 | Dare-Edwards | 252/57 |
| 4,830,769 | 5/1989 | O'Lenick, Jr. et al. | 252/49.3 |
| 4,871,476 | 10/1989 | Yoshimura et al. | 252/565 |
| 4,978,468 | 12/1990 | Yoshimura et al. | 252/79 |

FOREIGN PATENT DOCUMENTS

| | | |
|---|---|---|
| WO8707636 | 12/1987 | PCT Int'l Appl. . |
| 1180389 | 2/1970 | United Kingdom . |

OTHER PUBLICATIONS

Dare-Edwards, M. P., "A Novel Family of Traction Fluids Deriving from Molecular Design," *J. Synth. Lubr.*, 8-3, pp. 197-205 (1991).

Hentschel, K. H., "The Influence of Molecular structure on the Frictional Behaviour of Lubricating Fluids," *J. Synth. Lubr.*, 2-2, 143-165 (1985).

M. W. Ranney, "Synthetic Oils and Greases for Lubricants", Noyes Data Corporation, 1976, pp. 5-33.

S. Bair et al., "Some Observations in High Pressure Rheology of Lubricants", *Journal of Lubrication Technology*, vol. 104 (Jul. 1982), pp. 357-364.

S. Bair et al., "Shear Rheologial Characterization of Motor Oils®", presented at the 42nd Annual Meeting in Anaheim, California, May 11-14, 1987, pp. 317-324.

*Primary Examiner*—Prince Willis, Jr.

*Assistant Examiner*—Cephia D. Toomer

*Attorney, Agent, or Firm*—Panitch Schwarze Jacobs & Nadel

[57] ABSTRACT

Metal-metal surface contact systems in metalworking processes may be lubricated by applying thereto a composition comprising an ester, wherein the ester has a full film traction coefficient of less than about 0.05 at a pressure of about 0.5 to about 1.2 GPa, a temperature of about 50° C. and a sliding velocity of about 0.5 to about 10 $msec^{-1}$. The ester is represented by the general formula:

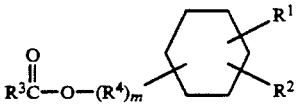

(I)

where $R^1$ and $R^2$, $R^3$ and $R^4$ and m are set forth in the Summary of the Invention. The composition may be mixed with a solvent to form a solution or emulsified prior to application to the metallic surface.

11 Claims, No Drawings

METHOD FOR LUBRICATING METAL-METAL CONTACT SYSTEMS IN METALWORKING OPERATIONS WITH CYCLOHEXYL ESTERS

FIELD OF THE INVENTION

The present invention relates to a method for lubricating metal-metal contact systems. More particularly, the invention is directed to a method for lubricating metallic surfaces with compositions which can replace or augment conventional synthetic ester lubricants and other natural fats in applications such as metalworking processes.

BACKGROUND OF THE INVENTION

As metalworking processes become more complex and sophisticated and operate at higher pressures and speeds, increased demands are placed on lubricants to withstand the severe forces generated by hostile environments of the metalworking processes. Typical metalworking processes involve elastic or plastic deformation or cold working of metals. Examples of such metalworking processes include cold rolling of steel or aluminum sheets or foils, stamping, drawing, ironing, cutting, grinding, broaching, drilling and machining of metallic materials. The metallic materials from which the metalworking apparatus and articles to be fabricated are made include steel, cast iron, and ferrous alloys, as well as aluminum alloys and other non-ferrous alloys including such components as titanium, magnesium, copper, tin and brass.

Desirable lubricants not only reduce the coefficient of sliding friction between contacting metallic surfaces, but, among other attributes, control the temperature of the metalworking components and article during the metalworking process.

Lubricants are generally any liquid or solid which when used alone or with other components of a composition reduce friction between metallic parts and facilitate metal removal. Lubricity is the ability of a lubricant material to effectively reduce friction and wear of two metallic surfaces in processes involving elastic or bulk plastic deformation of one or both of the metallic surfaces. Lubricity of a lubricant is reflected in the degree of smoothness of surface finish of a product of a metalworking process following deformation, as well as the ability to control the temperature of the metalworking components and article during deformation and strain distribution in the metal product formed during the metalworking process.

Presently, conventional synthetic ester lubricants, such as polyol esters, and other natural fats are used as lubricating fluids for metalworking operations. U.S. Pat. No. 3,526,596 discloses that polyol esters of fatty acids having twelve to twenty-two carbon atoms, preferably polyols having two to twelve hydroxy groups and glycols having two to forty carbon atoms, are useful as lubricants in metalworking operations.

U.S. Pat. No. 3,681,440 discloses lubricants of esters derived from aliphatic or aromatic monocarboxylic acids and dineoalkyl ethers having a tetrahydroxy functionality.

U.S. Pat. No. 4,178,261 discloses a base lubricating oil of a carboxylic acid ester formed by reacting 6-cyclohexylhexanoic acid, optionally in combination with an aliphatic monocarboxylic acid having 4 to 20 carbon atoms, with a polyhydric alcohol.

U.S. Pat. No. 4,871,476 discloses a synthetic lubricating fluid for power transmissions which comprises (a) an ester or its derivative of cyclohexanol and cyclohexanecarboxylic acid or its derivative; and (b) 1% to 70% by weight of a branched poly-α-olefin. The ester has a traction coefficient about 5% to 7% higher than those of commercially available traction-based oils having a viscosity in the same range.

U.S. Pat. No 4,786,427 discloses lubricants of ester compounds for use in traction drives. U.S. Pat. No. 4,978,468 also discloses a traction fluid, the fluid comprising (1) at least one ester compound or its derivative containing a cyclohexyl or alkyl substituted cyclohexyl group joined to a linear chain hydrocarbon group by an ester group; and (2) 0.1% to 95% by weight of at least one polymer selected from hydrocarbon polymers, such as polyolefins and hydrogenation polyolefins, and polyesters such as polyacrylates and polymethacrylates. The ester components exhibit high traction coefficients in excess of 0.075.

In metalworking operations, as opposed to traction drives, it is desirable to have a lubricant possessing low full film traction and sliding friction coefficients. Full film lubrication is defined herein to mean a condition of lubrication in which the film thickness of the lubricant is appreciably greater than that required to cover the surface asperities of the metallic surface when subjected to the operating load, so that the effect of the surface asperities is not noticeable. See Organization For Economic Cooperation and Development, *Friction, Wear and Lubrication Glossary* at page 61 (Paris, 1969). In regions where full film lubrication cannot be achieved, it is desirable that such a lubricant have a low full film traction coefficient under hydrodynamic lubricating conditions and a low friction coefficient under boundary lubricating conditions.

Lubricants for use in metalworking operations must be capable of withstanding the high shear forces, temperatures and pressures encountered in such operations and provide a film of sufficient thickness to protect contacting metallic surfaces. Such a lubricant should resist viscosity changes during the metalworking process and possess a shear yield stress lower than that of the metallic surfaces. Ductility and mobility under severe operating conditions and a high affinity for metallic surfaces for inhibiting metal-to-metal contact between the surfaces is also desirable.

It is desirable for a metalworking lubricant to have not only high pressure rheological and low traction properties but also to exhibit hydrolytic stability. Typical known synthetic esters, primarily of the neopentyl type, suffer from hydrolytic instability. High stability to oxidative or hydrolytic breakdown is particularly important, because thermal or hydrolytic decomposition can result in the lubricant itself becoming corrosive and/or volatile, as well as generally less effective. Also, as the lubricant degrades, sludge and other decomposition products may deposit or form on the surfaces of the metallic components and articles and adversely affect the metalworking process.

Other drawbacks of lubricants suffering from thermal and hydrolytic instability include discoloration of the work product and degradation in the quality of the work product due to inconsistencies in the machining process because of viscosity changes or coating ability of the lubricant. Thus, it is desirable to have a lubricant which possesses not only a low coefficient of sliding friction, but also one which is hydrolytically stable to counteract water added to emulsify the lubricant composition and water used to cool the metal surfaces during the metalworking processes.

BRIEF SUMMARY OF THE INVENTION

To facilitate metalworking processes and inhibit thermal and hydrolytic instability of lubricants during metalworking processes, among other advantages, a method for lubricating metal-metal surface contact systems in metalworking operations is provided by the present invention. The method comprises applying to a metallic surface a composition comprising an ester, wherein the ester has a full film traction coefficient of less than about 0.05 at a pressure of about 0.5 to about 1.2 GPa, a temperature of about 50° C. to about 150° C. and a sliding velocity of about 0.5 to about 10 $msec^{-1}$. The ester is represented by the formula (I):

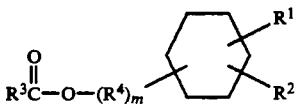

(I)

where m is an integer of 0 or 1, $R^1$ and $R^2$ are each independently selected from the group consisting of H, $$-(R^5)_n-O-\overset{O}{\overset{\|}{C}}R^6,$$

a saturated or unsaturated, linear or branched chain hydrocarbon having 1–8 carbon atoms and a group represented by the formula (II):

$$-O\overset{O}{\overset{\|}{C}}-(CH_2)_p-\overset{O}{\overset{\|}{C}}O-A \qquad \text{(II)}$$

where n is an integer of 0 or 1 and p is an integer of 1 to 10, A is selected from the group consisting of H, Na, Li, K, a primary amine, a secondary amine and a tertiary amine, each of $R^3$ and $R^6$ is independently a saturated or unsaturated, branched chain or linear hydrocarbon comprising 8 to 35 carbon atoms, and each of $R^4$ and $R^5$ is independently a straight chain alkyl group having 1 to 3 carbons. The metallic surface having the composition applied thereto may be contacted with another metallic surface, for example in a metalworking operation. When used as lubricants in metal-metal surface contact systems, such as metalworking operations, the foregoing compositions have been found to demonstrate extremely high resistance to chemical hydrolysis, while also providing desirable lubrication properties as measured by full film traction coefficients.

DETAILED DESCRIPTION OF THE PREFERRED EMBODIMENTS

In the present method, the composition comprising the ester is applied to the metallic surface of the article or metalworking component by standard methods such as spraying, flooding, roll coating and dip application techniques, to name a few. Generally the composition is applied prior to metalworking as a liquid, although the applied composition may be dried prior to metalworking by conventional methods well known to an ordinarily skilled artisan.

The amount of lubricant composition required for effective performance depends upon the specific metalworking operation and the parameters of the operation, as well as the properties of the metal workpiece and metal tooling. Preferably, the lubricant should be applied in an amount sufficient to form a "full film", i.e., one thick enough to cover all of the surface asperities, although this will not be possible or practical where the surface roughness of the metal is high. After the lubricant composition is applied to the metallic surface, the lubricated surface may be contacted with an opposing metallic surface, e.g., the metalworking tool.

The composition comprises an ester of formula (I). The ester has a full film traction coefficient of less than about 0.05, at a contact pressure of between about 0.5 and about 1.2 GPa, a temperature between about 50° C. and about 150° C. and a sliding velocity of about 0.5 to about 10 $msec^{-1}$. Preferably, the full film traction coefficient of the ester is less about 0.03. The composition of the present invention may be applied as a lubricant over a wide range of operating conditions. The conditions specified above merely define the conditions for determining the full film traction coefficient of the ester and are not intended to limit the range of operating conditions under which the present composition may be applied as a lubricant according to the present method.

The ester of formula (I) may be prepared by a variety of methods. For example, one mole of a cyclohexyl alcohol may be reacted with one mole of a monobasic fatty acid in the presence of a suitable sulfonic acid catalyst, such as methanesulfonic acid. Suitable cyclohexyl alcohols include, for example, cyclohexanol, cyclohexanediol and cyclohexanetriol. One of ordinary skill in the art would understand that other esterification techniques including reaction of the cyclohexyl alcohol, cyclohexyldiol, or cyclohexyltriol with appropriate acid chlorides or anhydrides, among other methods, may be used to produce the ester of formula (I).

Preferably, $R^1$ and $R^2$ are selected from the group consisting of H, $-CH_3$, $-CH_2CH_2CH_3$, $-CH_2CH_3$, $$-C(CH_3)_3 \quad \text{and} \quad -(R^5)_n-O-\overset{O}{\overset{\|}{C}}R^6,$$

where n=0, and $R^1$ may be the same as or different from $R^2$.

In one preferred embodiment of the present method, m and n are each 0, $R^1$ is H, $R^2$ is selected from the group consisting of H and a linear or branched chain hydrocarbon having 1–4 carbon atoms and $R^3$ is a saturated or unsaturated, linear hydrocarbon having 11–21 carbon atoms as the ester of formula I. In this embodiment, the ester functions well not only as a lubricant, but exhibits good hydrolytic stability and compatibility with other components used in metalworking lubricating products. An example of such an ester is 4-tert-butyl cyclohexyl laurate. A method of preparing 4-tert-butyl cyclohexyl laurate in accordance with the present invention is set forth in Preparation Example I.

PREPARATION EXAMPLE I

The compound 4-tert-butyl cyclohexyl laurate in which m and n are each 0, $R^1$ is H, $R^2$ is a tert-butyl group, and $R^3$ is a saturated linear hydrocarbon of 11 carbon atoms, was prepared in the following manner. Fifty grams of 4-tert-butyl cyclohexanol (0.32 mol), 64.64 grams dodecanoic acid (0.32 mol) and 0.27 grams of methanesulfonic acid were added to a 250 ml round bottom flask fitted with a magnetic stirrer, distillation head, and source of nitrogen. The mixture was heated to 180° C. under a nitrogen blanket and continuously stirred. Water evolved from the reaction mixture was collected by distillation until 5.76 grams (0.32 mol) of evolved water was collected. The reaction mixture was cooled to room temperature (about 25° C.) and dissolved in 500 ml of commercially available reagent grade hexanes. This mixture was washed three times with 200 ml per wash of a saturated aqueous solution of sodium bicarbonate. The mixture was then dried over silica gel and the hexanes were removed by vacuum distillation to yield 4-tert-butyl cyclohexyl laurate and minor amounts of unreacted 4-tert-butyl cyclohexanol. The unreacted 4-tert-butyl cyclohexanol was removed by vacuum distillation to yield a colorless liquid of 4-tert-butyl cyclohexyl laurate.

In another embodiment, in the ester of formula (I), m and n are each 0, $R^1$ is H, $R^2$ is selected from H and $$-\overset{\overset{\displaystyle O}{\|}}{O}CR^6,$$

and $R^3$ and $R^6$ are each unsaturated, linear hydrocarbons having 17 carbon atoms. An example of an ester according to this embodiment is cis/trans-1,4-cyclohexanediol dioleate. A method for preparing cis/trans-1,4-cyclohexanediol dioleate is set forth in Preparation Example II.

PREPARATION EXAMPLE II

The compound cis/trans-1,4-cyclohexanediol dioleate, where m and n are each 0, $R^1$ is H, $R^2$ is $$-\overset{\overset{\displaystyle O}{\|}}{O}CR^6$$

and $R^3$ is equal to $R^6$, both being $-C_{17}H_{33}$, was prepared in the following manner: 116.1 grams (1.0 mol) of cis/trans-1,4-cyclohexanediol, 560 grams (2.0 mol) of cis-$\Delta^9$-octadecenoic acid and 1.0 grams of methanesulfonic acid were added to a 1000 ml round bottom flask fitted with a magnetic stirrer, distillation head, and source of nitrogen. The reaction mixture was heated to 185° C. under a nitrogen blanket and water which was evolved was continuous collected by distillation until 36 grams (2.0 mol) of water was collected. The reaction mixture was cooled to room temperature (about 25° C.) and dissolved in 1000 ml of reagent grade hexanes. The solution was washed three times with 300 ml per wash of a saturated aqueous solution of sodium bicarbonate. The washed solution was dried over silica gel and the hexanes were removed by vacuum distillation to yield a pale yellow liquid of cis/trans-1,4-cyclohexanediol dioleate.

In yet another embodiment of the present method, in the ester of formula (I), m and n are each 0, $R^1$ is H, $R^2$ is selected from the group consisting of H, $CH_3$, $CH_3CH_2$, $R^2$ being located at a position on the cyclohexyl ring which is vicinal to $$R^3\overset{\overset{\displaystyle O}{\|}}{C}O-,\quad R^3$$

being an unsaturated, linear hydrocarbon having 17 carbon atoms. Such esters exhibit high hydrolytic stability and excellent lubricant performance. Examples of such esters are the compounds 2-methylcyclohexyl oleate and cyclohexyl oleate. Methods for preparing 2-methylcyclohexyl oleate and cyclohexyl oleate are set forth in Preparation Examples III and IV, respectively.

PREPARATION EXAMPLE III

The compound 2-methylcyclohexyl oleate, where m and n are each 0, $R^1$ is H, $R^2$ is $CH_3$ and $R^3$ is $-C_{17}H_{33}$, was prepared in the following manner: 68.4 grams (0.60 mol) of 2-methylcyclohexanol and 168 grams (0.6 mol) of $\Delta^9$-octadecenoic acid were combined with 0.6 grams of methanesulfonic acid in a 500 ml round bottom flask fitted with a magnetic stirrer, distillation head and source of nitrogen. The mixture was heated to 185° C. under a nitrogen blanket. Water evolved during the reaction was collected by distillation until 10.8 grams (0.6 mol) of water was collected. The reaction mixture was cooled to room temperature (about 25° C.) and dissolved in 500 ml of hexanes. The solution was washed three times with 250 ml per wash of a saturated aqueous solution of sodium bicarbonate. The solution was dried over silica gel and the hexanes were removed by vacuum distillation to yield a pale yellow liquid, namely 2-methylcyclohexyl oleate.

PREPARATION EXAMPLE IV

The compound cyclohexyl oleate, where m and n are each 0, $R^1$ is H, $R^2$ is H and $R^3$ is $-C_{17}H_{33}$ was prepared in the following manner: 68.4 grams (0.60 mol) of cyclohexanol and 168 grams (0.6 mole) of $\Delta^9$-octadecenoic acid were combined with 0.6 grams of methanesulfonic acid in the same manner as set forth in Preparation Example III to yield a pale yellow liquid, namely cyclohexyl oleate.

An example of an ester according to the present invention having a group represented by formula (II) is given by the formula (III):

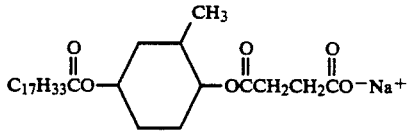

(III)

PREPARATION EXAMPLE V

The compound of formula (III) may be prepared in the following manner: 130 grams (1.0 mol) of 2-methyl-4-hydroxycyclohexanol and 230 grams (1.0 mol) of cis-$\Delta^9$-octadecenoic acid were combined with 1.0 gram of methanesulfonic acid in a 1000 ml round bottom flask fitted with a magnetic stirrer, distillation head and source of nitrogen. The mixture was heated to 185° C. under a nitrogen blanket. Water evolved during the reaction was collected by distillation until 18 grams (1.0 mol) of water was collected. The reaction mixture was cooled to a temperature between 50° and 55° C. and 250 ml of hexanes and 100.07 grams (1.0 mol) succinic anhydride were added. The mixture was stirred at a temperature of 50° to 55° C. for 24 hours. The hexanes were removed by vacuum distillation to yield an off-white solid. Four hundred grams of a 10 w/w % aqueous sodium hydroxide solution was added to the solid and the mixture was stirred for 60 minutes at a temperature of 30° to 35° C. An aqueous solution of the compound of formula III was thereby formed. The resulting product may be used as a water solution or the water can be removed and a solid compound may be obtained.

In another embodiment of the present method, in the ester of formula (I), m and n are each 1, $R^1$ is H, $R^2$ and $R^3$ are each an unsaturated linear hydrocarbon having 17 carbon atoms and $R^4$ and $R^5$ are each $CH_2$. This ester, 1,4-cyclohexanedimethyl dioleate, exhibits excellent lubrication properties and high hydrolytic stability. A method for preparing 1,4-cyclohexanedimethyl dioleate is set forth in Preparation Example VI.

PREPARATION EXAMPLE VI

The compound 1,4-cyclohexanedimethyl dioleate, where m and n are each 1, $R^1$ is H, $R^2$ and $R^3$ are each $-C_{17}H_{33}$ and $R^4$ and $R^5$ are each $CH_2$ was prepared in the following manner: 144.21 grams (1.0 mol) of 1,4-cyclohexanedimethanol and 560 grams (2 moles) of $\Delta^9$-octadecenoic acid were combined with 1 gram of methanesulfonic acid in the same manner as set forth in Preparation Example III to yield a pale yellow liquid, namely, 1,4-cyclohexanedimethyl dioleate.

In one embodiment of the invention, the ester may be mixed with a hydrocarbon solvent to form a solution of the ester for applying to the metallic surface. Examples of suitable hydrocarbon solvents include paraffinic, naphthenic and aromatic petroleum oils, kerosenes, varsols, mineral spirits, synthetic oils, polybutenes, polyisoprenes and mixtures thereof.

Other additives which may be combined with the ester or solution thereof include rust or corrosion inhibitors, emulsifying agents, antioxidants or oxidation inhibitors, dyes, haze inhibitors, detergents, dispersants, viscosity index improvement agents, pour point reducing agents, biocides, biostatic agents and extreme pressure lubricants, to name a few. Relative percentages of hydrocarbon solvents and additives combined with esters according to the present invention may vary based upon such factors as the intended use of the lubricant and the particular esters, hydrocarbon solvents, and additives.

In another embodiment of the present invention, the ester lubricant may include water so that the composition is in the form of an emulsion for applying to the surface of the metallic article. Generally, the amount of water used to form the emulsion may range up to about 99 weight percent. The amount of water used to form the emulsion may vary based upon variables too numerous to mention, such as the choice of ester, the metallic article to which the emulsion is to be applied, the environment in which the emulsion is to be applied to the surface of the metallic article, etc.

In yet another embodiment, about 10 to about 50 weight percent of an ester according to formula (I) is mixed with about 10 to about 80 weight percent of a naphthenic mineral oil, 0 to about 20 weight percent of at least one of an amine or alkaline metal salt of a carboxylic acid, 0 to about 20 weight percent of a corrosion inhibitor, 0 to about 15 weight percent of at least one of a biostatic agent and a biocidal agent, about 5 to about 20 weight percent of a nonionic emulsifying additive, 0 to about 10 weight percent of a cosolvent, such as ethylene glycol, diethylene glycol or isopropanol, and 0 to about 20 weight percent of an extreme pressure lubricant to form a solution. The amine or alkaline metal salt of a carboxylic acid is generally an emulsifier and a rust inhibitor and may be used as a co-emulsifier with the nonionic emulsifying additive. A suitable emulsion may be formed by mixing about 2 to about 50 weight percent of the above solution with about 50 to about 98 weight percent water. Such a solution, when used in neat or emulsified form, performs effectively in metalworking operations involving ferrous and nonferrous alloys and is particularly useful for drawing of steel and aluminum metal parts.

In another embodiment, in the ester of formula (I), m and n are each 0, $R^1$ is H, $R^2$ is selected from the group consisting of H, $CH_3$ and $-CH_2CH_3$ and $R^3$ is a saturated or unsaturated, linear hydrocarbon chain having 11 to 21 carbon atoms. About 10 to about 30 weight percent of such an ester is mixed with about 50 to about 80 weight percent of at least one of a naphthenic mineral oil and a paraffin mineral oil, about 5 to about 15 weight percent of an alkaline metal salt of a fatty acid mixture comprising a fatty acid having 10 to 22 carbons atoms, about 0 to about 15 weight percent of at least one of a biocidal agent and a biostatic agent, about 5 to about 20 weight percent of a nonionic emulsifier and about 5 to about 15 weight percent of at least one of a corrosion inhibitor and a rust preventive additive. About 5 to about 20 weight percent of the solution may be mixed with water to form an emulsion for applying to the metallic article. Such a solution, whether applied neat or as an emulsion, is effective for metalworking operations on steel and aluminum alloys and is particularly suited for such operations as broaching cutting, drilling, grinding, drawing and stamping.

In another embodiment, about 30 to about 70 weight percent of an ester according to the present invention is mixed with about 10 to about 20 weight percent of a naphthenic mineral oil, 0 to about 15 weight percent of an emulsifier, 0 to about 5 weight percent of at least one of an antioxidant and an oxidation inhibiting additive and about 5 to about 20 weight percent of at least one of an extreme pressure lubricating additive and an antiwear lubricating additive. About 0.5 to about 20 weight percent of the solution so formed may be mixed with water to form an emulsion for applying to the metallic article. Such a solution, in either neat or emulsified form, performs effectively in metalworking operations such as drawing and forming of aluminum and steel alloys.

In another embodiment, in the ester of formula (I), m and n are each 0, $R^1$ is H, $R^2$ is $$-\overset{\overset{\displaystyle O}{\|}}{O}CR^6$$

and $R^3$ and $R^6$ are independently selected from a saturated or an unsaturated, linear hydrocarbon having 11 to 21 carbon atoms. About 40 to about 70 weight percent of such an ester is mixed with about 10 to about 20 weight percent of a mineral oil, about 3 to about 10 weight percent of an emulsifier, 0 to about 1 weight percent of an oxidation inhibiting additive and about 10 to about 15 weight percent of at least one of an extreme pressure additive and an antiwear additive to form a solution. About 0.5 to about 5 weight percent of the solution may be mixed with water to form an emulsion for applying to the surface of the metallic article. Such a neat solution or emulsion is an effective lubricant for cold rolling of steel and non-ferrous alloys, for example.

In another embodiment, about 30 to about 85 weight percent of an ester according to the present invention is mixed with about 15 to about 60 weight percent of a synthetic hydrocarbon, about 5 to about 20 weight percent of a corrosion inhibitor, about 5 to about 15 weight percent of an emulsifier, and 0 to about 10 weight percent of at least one of a biocidal agent and a biostatic agent. About 0.5 to about 10 weight percent of the solution may be mixed with water to form an emulsion. Such a solution, whether applied neat or as an emulsion, is useful as a lubricant for metalworking operations of steel and aluminum alloys, including drawing and ironing of aluminum cups and cans, for example.

In another embodiment, m and n are each 0, $R^1$ is H, $R^2$ is $$-OC(=O)R^6$$

and $R^3$ and $R^6$ are independently selected from a linear unsaturated hydrocarbon having 11 to 17 carbon atoms. About 30 to about 50 weight percent of such an ester is mixed with about 40 to about 70 weight percent of a medium molecular weight polybutene, about 10 to about 15 weight percent of an emulsifier, about 1 to about 4 weight percent of a corrosion inhibiting additive, and 0 to about 1 weight percent of a biocidal agent. About 1 to about 10 weight percent of such a solution may be mixed with water to form an emulsion for applying to the surface of the metallic article. Such a solution, whether in neat or emulsified form, is useful for metalworking operations, such as drawing and ironing, to name a few.

COMPARATIVE TEST EXAMPLE I

In many industrial metalworking processes, and particularly in the cold rolling of steel sheets, the high pressure rheological properties and traction properties of a lubricant under elastohydrodynamic (EHD) lubrication conditions are critical to effective performance of the metalworking lubricant. In such operations, effective lubricants are often characterized by relatively low pressure-viscosity coefficients and low traction coefficients under conditions of elastohydrodynamic contacts. Table 1 lists the low pressure-viscosity coefficients and full-film traction coefficients of cyclohexanediol diesters according to the present invention as well as results obtained for commonly used synthetic esters, including neopentyl esters. Each of the lubricants was tested in neat form.

Pressure-viscosity coefficients were obtained using a falling body viscometer according to procedures described by S. Bair et al., "Some Observations in High Pressure Rheology of Lubricants", 104 *Journal of Lubrication Technology* at pages 357–364 (July 1982). Elastohydrodynamic (EHD) traction coefficients were obtained using an EHD concentrated Contact Simulator. This apparatus and procedure of use are discussed in detail by S. Bair et al., "Shear Rheological Characterization of Motor Oils", 31(3) *Tribology Transactions* at pages 316–324 (1987).

TABLE 1

HIGH PRESSURE RHEOLOGY AND EHD TRACTION COEFFICIENTS

| | Traction Coefficient 100° C., 5 m/s Sliding | Pressure - Viscosity Coefficient (100° C.) |
|---|---|---|
| Lubricant | | |
| 1,4-Cyclohexanediol diester of tallow fatty acids | .0083 | 9.36 |
| 1,4-Cyclohexanediol dioleate | .0108 | 8.13 |
| 1,4-Cyclohexanediol dilaurate | .0116 | 10.3 |
| 1,2-Cyclohexanediol dioleate | .0133 | 10.33 |
| Control Lubricants | | |
| Trimethylol propane trioleate | .0094 | 8.34 |
| Trimethylolpropane tristearate | .0136 | 10.33 |
| Trimethylolpropane triisostarate | .0149 | 11.37 |
| Pentaerythritol tetraoleate | .0089 | 9.51 |
| 200 SUS Naphthenic Mineral Oil | .0492 | 17.10 |

The results of the tests shown in Table 1 show that comparable or lower traction coefficients and pressure-viscosity coefficients may be obtained using esters of the present invention compared to common neopentyl esters. The cyclohexyl esters of the present invention also exhibit superior stability to hydrolysis, which is of particular advantage in metalworking operations.

COMPARATIVE TEST EXAMPLE II

To further demonstrate the utility of the present method for replacing common synthetic ester lubricants as metalworking fluids, the lubricant of Example IV, namely cyclohexyl oleate, was compared to a control composition of a typical neopentyl triol ester product, "MICROCUT", which is commercially available from Quaker Chemical Corporation of Conshohocken, Pa. The cyclohexyl oleate was included in a test formulation having the same anticorrosion additives, extreme pressure and antiwear lubricants, emulsifiers and biocides as the control composition. A problem typically encountered with neopentyl triol ester lubricant products is poor hydrolytic stability of the synthetic ester lubricant, which results in a rapid instability of the neat product in storage and of the emulsified product in operation. Various other synthetic esters, primarily of the neopentyl type, were also evaluated but suffered from similar instability properties. Table 2 sets forth the results of several standard tests which were conducted to evaluate the characteristics of the control composition containing the original neopentyl polyol ester and a similar formulation in which the neopentyl polyol ester was replaced with the cyclohexyl oleate of Example IV.

The composition containing the cyclohexyl oleate has a neat product storage stability of greater than 115 days, which is more than twice the length of time that the neopentyl ester control composition remained stable.

The Falex Pin on Block Test was conducted on both neat product and 5 weight percent of the product emulsified in water. The Falex (FAVILLE-LeVALLY) tests were conducted on a Falex Lubricant Tester, which is described, for example, in *United States Steel Lubrication Engineer's Manual* at pages 136–37. In this test, a steel pin revolves at 290 rpm between two steel blocks immersed in the test oil. The pressure exerted between the blocks on the pin is increased until the steel pin fails, either by sudden sheering or wear occurring at a rate faster than the load can be increased. The maximum measurable failure load is 4500 p.s.i.

Based on the test results shown in Table 2, the cyclohexyl oleate compound of the present invention shows excellent metalworking properties. The Falex EP fail load values (namely 2250 lb-ft) for the cyclohexyl oleate compound are similar to the values obtained for the neopentyl ester control composition. The block conditions and journal conditions for the neopentyl ester control composition and cyclohexyl oleate composition were also comparable.

TABLE 2

| | Neopentyl Ester | Cyclohexyl Oleate |
|---|---|---|
| 1. Neat Product Stability | 45 days | >115 days |
| 2. Falex Pin on Block Lubrication (Neat Product) Test 1137 Steel Pin/380 Al Block | | |
| Final Load (lb-ft) | 2250 | 2250 |
| Breaking Point (lb-ft) | 2250 | 2250 |
| Final Torque (in-lb-ft) | 18 | 17 |
| Average Torque (in-lb-ft) | 17.5 | 12.9 |
| Average Test/Wear | 94.5 | 91.6 |
| Block Condition | Light wear smooth surface | Light wear smooth surface |
| Journal Condition | Light wear | Light wear |
| 3. Falex Pin on Block Test 5% Emulsions) | | |
| Final Load (lb-ft) | 2250 | 2000 |
| Final Torque (in-lb-ft) | 35 | 30 |
| Average Torque (in-lb-ft) | 23.5 | 21.1 |
| Average Teeth/Wear | 84.7 | 81.1 |
| Block Condition | Very light wear smooth surface | Very light wear smooth surface |
| Journal Condition | Very light wear smooth surface | Very light wear smooth surface |
| 4. Four Ball EP Test (ASTM D2596) 1800 RPMs 5 minute breakin at 7.5 kg 5% concentration in distilled water | | |
| Final Load (kg) | 180 | 180 |
| Avg. Scar (mm) | 1.0 | 0.975 |
| 5. Four Ball Wear Test (ASTM D4172) 1200 RPMs 5 minutes at 7.5 kg 30 minutes at 165 kg 5% concentration in distilled water | | |
| Average Scar (mm) | 2.32 | 1.62 |

The Four-Ball EP tests (ASTM D-2596 and ASTM D-4172) measure the extreme pressure characteristics of a lubricant as indicated by the final or weld load and average scar length. The Four-Ball EP test is conducted by rotating a test ball under load, the test ball being located at a tetrahedral position on top of three stationary balls which rest in the test lubricant. Measurements of scars on the three stationary balls are used to calculate the average scar value. The final load is the load just prior to which welding occurs or the maximum load just before welding. At a maximum load of 180 kg, the fluids prevented welding throughout the entire test. Based on the results shown in Table 2, the final load values for the control composition containing the neopentyl ester and the composition containing the cyclohexyl oleate were 180 kg for each composition. However, the average scar length for the cyclohexyl oleate composition was less than that of the neopentyl ester control composition.

COMPARATIVE TEST EXAMPLE III

To further demonstrate the utility of the present method in providing improved hydrolytic stability over commonly used synthetic ester lubricants, the lubricants of Preparation Example IV, namely cyclohexyl oleate, and Preparation Example VI, namely 1,4-cyclohexanedimethyl dioleate, were compared in laboratory hydrolysis testing to three different ester lubricants typically included in metalworking fluids, namely isopropyl oleate, trimethylolpropane triester and glycerol trioleate.

The hydrolytic stability of a lubricant may be evaluated by measuring the change in acid number over a 75-hour period under the test conditions set forth below. In evaluating the hydrolytic stability of a lubricant, a change in the acid number of the lubricant as small as 0.5 to 1.0 may be considered detrimental to the effectiveness of the lubricant in maintaining hydrolytic stability. In the test method, 50 grams of each ester lubricant (neat) was blended with 20 grams of polyoxyethylene nonyl phenol, a nonionic emulsifier, and each mixture was added to 130 grams of distilled water to yield a 35% emulsion of the mixture in water. Triethanolamine vas added to each emulsion in amounts, typically of about 0.05 to about 0.1 grams, sufficient to raise the pH of each emulsion to 7.0. The acid number of each emulsion was measured by determining the milligrams of KOH required to neutralize one gram of emulsion. Using a reflux condenser, each emulsion was heated to reflux with continuous stirring and these conditions were maintained for 75 hours. After 75 hours had elapsed, the acid number for each emulsion was determined as set forth above.

The results of the test shown in Table 3 show that both cyclohexyl oleate and 1,4-cyclohexanedimethyl dioleate are significantly more hydrolytically stable than the three conventional ester lubricants tested. Enhanced hydrolytic stability is particularly important in metalworking operations.

TABLE 3

| Lubricant | Change in Acid Number |
|---|---|
| Cyclohexyl oleate | 1.4 |
| 1,4-cyclohexanedimethyl dioleate | 0.8 |
| Isopropyl oleate | 3.8 |
| Trimethylolpropane triester | 5.0 |
| Glycerol trioleate | 5.6 |

The present method for lubricating the surface of a metallic article provides better lubricant stability, stability of compositions and emulsions containing the lubricant, corrosion control, lubricant performance and is inherently more resistant to base or acid catalyzed hydrolysis than polyol or branched acyclic esters commonly used as lubricants in metalworking processes. The present method also provides a number of other advantages, including desirable high pressure rheological and low full film traction properties and other numerous advantages discussed above.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the invention as defined in the appended claims.

We claim:

1. A method for lubricating metal-metal surface contact systems in metalworking operations, comprising:

applying to a metallic surface a composition comprising an ester, wherein the ester has a full film traction coefficient of less than about 0.05 at a pressure of about 0.5 to about 1.2 GPa, a temperature of about 50° C. to about 150° C. and a sliding velocity of about 0.5 to about 10 $msec^{-1}$, the ester being represented by the formula:

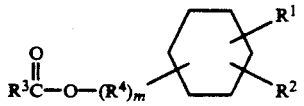

(I)

where m is an integer of 0 or 1, $R^1$ and $R^2$ are each independently selected from the group consisting of H, $$-(R^5)_n-O-\overset{O}{\overset{\|}{C}}R^6,$$

a saturated or unsaturated, linear or branched chain hydrocarbon having 1-8 carbon atoms and a group represented by the formula:

$$-O\overset{O}{\overset{\|}{C}}-(CH_2)_p-\overset{O}{\overset{\|}{C}}O-A \qquad (II)$$

where n is an integer of 0 or 1 and p is an integer of 1 to 10, A is selected from the group consisting of H, Na, Li, K, a primary amine, a secondary amine and a tertiary amine, each of $R^3$ and $R^6$ is independently a saturated or unsaturated, branched chain or linear hydrocarbon comprising 8 to 35 carbon atoms, and each of $R^4$ and $R^5$ is independently a straight chain alkyl group having 1 to 3 carbons; and contacting said metallic surface having said composition applied thereto with another metallic surface.

2. The method according to claim 1, wherein said traction coefficient of said ester is less than about 0.03.

3. The method according to claim 1, wherein $R^1$ is the same as $R^2$.

4. The method according to claim 1, wherein each of $R^1$ and $R^2$ is selected from the group consisting of H, $-CH_3$, $-CH_2CH_2CH_3$, $-CH_2CH_3$, $-C(CH_3)_3$ and $$-(R^5)_n-O-\overset{O}{\overset{\|}{C}}R^6,$$

where n=0.

5. The method according to claim 1, where m and n are each 0, $R^1$ is H, $R^2$ is selected from the group consisting of H and a linear or branched chain hydrocarbon having 1–4 carbon atoms and $R^3$ is a saturated or unsaturated, linear hydrocarbon having 11 to 21 carbon atoms.

6. The method according to claim 4, where m and n are each 0, $R^1$ is H, $R^2$ is selected from H and $$-O\overset{O}{\overset{\|}{C}}R^6$$

and $R^3$ and $R^6$ are each unsaturated, linear hydrocarbons having 17 carbon atoms.

7. The method according to claim 4, where m and n are each 0, $R^1$ is H and $R^2$ is selected from the group consisting of H, $CH_3$, $CH_3CH_2$—, $R^2$ being located at a position on the cyclohexyl ring which is vicinal to $$R^3\overset{O}{\overset{\|}{C}}-O-(R^4)_m-, \quad R^3$$

being an unsaturated, linear hydrocarbon having 17 carbon atoms.

8. The method according to claim 1, further comprising the step of mixing said composition with water to form an emulsion for applying to said metallic surface.

9. The method according to claim 1, further comprising the step of mixing said ester with a hydrocarbon solvent to form a solution thereof for applying to said metallic surface.

10. The method according to claim 9, wherein said hydrocarbon solvent is selected from the group consisting of paraffinic, naphthenic and aromatic petroleum oils, kerosenes, varsols, mineral spirits, synthetic oils, polybutenes, polyisoprenes and mixtures thereof.

11. The method according to claim 9, further comprising the step of mixing said solution with water to form an emulsion for supplying to said metallic surface.

* * * * *